US011502419B1

(12) United States Patent
Thai et al.

(10) Patent No.: US 11,502,419 B1
(45) Date of Patent: Nov. 15, 2022

(54) STANDARD PRINTED CIRCUIT BOARD PATCH ARRAY

(71) Applicant: Anokiwave, Inc., San Diego, CA (US)

(72) Inventors: Trang Thai, San Diego, CA (US); Jason Leo Durbin, San Diego, CA (US); Peter Moosbrugger, San Diego, CA (US)

(73) Assignee: Anokiwave, Inc., San Diego, CA (US)

( * ) Notice: Subject to any disclaimer, the term of this patent is extended or adjusted under 35 U.S.C. 154(b) by 56 days.

(21) Appl. No.: 17/100,023

(22) Filed: Nov. 20, 2020

Related U.S. Application Data

(60) Provisional application No. 62/938,469, filed on Nov. 21, 2019.

(51) Int. Cl.

| | |
|---|---|
| ***H01Q 21/00*** | (2006.01) |
| ***H01Q 21/06*** | (2006.01) |
| ***H01Q 9/04*** | (2006.01) |

(52) U.S. Cl.
CPC ..... *H01Q 21/0087* (2013.01); *H01Q 9/0414* (2013.01); *H01Q 21/065* (2013.01)

(58) Field of Classification Search
CPC . H01Q 21/0087; H01Q 9/0414; H01Q 21/065
USPC ..... 343/893
See application file for complete search history.

(56) References Cited

U.S. PATENT DOCUMENTS

| | | | | |
|---|---|---|---|---|
| 8,502,735 | B1 | 8/2013 | Moosbrugger et al. | |
| 2019/0260110 | A1 | 8/2019 | Thai et al. | |
| 2020/0028490 | A1* | 1/2020 | Kato | H03H 9/542 |
| 2020/0106188 | A1* | 4/2020 | Ou | H01Q 5/357 |

* cited by examiner

*Primary Examiner* — Peguy Jean Pierre
(74) *Attorney, Agent, or Firm* — Nutter McClennen & Fish LLP

(57) ABSTRACT

A patch array has a routing printed circuit board with a plurality of layers for routing signals, and a plurality of printed circuit board patches that each has at least one through-via. The plurality of patches are mounted with the routing printed circuit board. In addition, the plurality of printed circuit board patches are formed in compliance with standard printed circuit board rules.

17 Claims, 16 Drawing Sheets

STANDARD PRINTED CIRCUIT BOARD PATCH ARRAY

CROSS-REFERENCE TO RELATED APPLICATION(S)

This patent application claims the benefit of U.S. Provisional Patent Application No. 62/938,469 entitled STANDARD PRINTED CIRCUIT BOARD PATCH ARRAY filed Nov. 21, 2019, which is hereby incorporated herein by reference in its entirety.

FIELD OF THE INVENTION

Illustrative embodiments of the invention relate to phased arrays and, more particularly, the illustrative embodiments of the invention relate to phased arrays operating in the millimeter wave spectrum.

BACKGROUND OF THE INVENTION

Active electronically steered/ scanned antenna systems ("AESA systems,"a type of "phased array system") or active antenna systems form electronically steerable beams for a wide variety of radar and communications systems. To that end, AESA systems typically have a plurality of beam-forming elements (e.g., antennas) that transmit and/or receive energy so that such energy can be coherently combined (i.e., in-phase and amplitude). This process is referred to in the art as "beamforming" or "beam steering." Specifically, for transmission, many AESA systems implement beam steering by providing various RF phase shift and gain settings. The phase settings and gain weights together constitute a complex beam weight between each beam-forming element. For a signal receiving mode, many AESA systems use a beamforming or summation point.

To achieve beam-forming using an antenna array, each antenna element is connected to a semiconductor integrated circuit generally referred to as a "beam-forming IC." This microchip/integrated circuit may have a number of sub-circuit components implementing various functions. For example, those components may implement phase shifters, amplitude control modules or a variable gain amplifier (VGA), a power amplifier, a power combiner, a digital control, and other electronic functions. Such an integrated circuit is packaged to permit input and output radio frequency (RF) connections.

The process of fabricating the beam-forming elements on a substrate can produce a variety of complex design issues that can adversely affect yield and system performance.

Preferred embodiments use standard printed circuit board fabrication processes (e.g., not using high density interconnect processes) to produce the plurality of patches. In fact, each of the plurality of patches may include a plurality of antennas, or a single antenna.

SUMMARY OF VARIOUS EMBODIMENTS

In accordance with one embodiment of the invention, one embodiment of the invention, a patch array has a routing printed circuit board with a plurality of layers for routing signals, and a plurality of printed circuit board patches that each has at least one through-via. The plurality of patches are mounted with the routing printed circuit board. In addition, the plurality of printed circuit board patches are formed in compliance with standard printed circuit board rules.

In accordance with another embodiment of the invention, a patch array has a routing substrate with a plurality of layers for routing signals, and a plurality of patches surface mounted with the routing substrate. Each of the patches is formed as a printed circuit board having at least one through-via and configured to communicate in the 5G spectrum operating at relative bandwidths within a given spectrum of between about 8 percent and about 70 percent.

Among other ranges, the relative bandwidths may be between about 24 GHz and 49 GHz (e.g., between about 24 GHz and 28 GHz). The plurality of patches may surface mounted to the routing substrate using any of a variety of coupling technologies, such as a ball grid array.

The relative bandwidth is considered to be the difference between the highest and lowest frequencies of the given spectrum divided by the midpoint frequency between the highest and lowest frequencies. Preferably, the routing substrate and/or plurality of patches each has standard vias and/or is free of micro-vias. To optimize performance, in some embodiments, the plurality of patches includes one or more stacked patches.

In accordance with other embodiments, a method of forming a patch array provides a routing substrate having a plurality of layers for routing signals, and surface mounts a plurality of patches surface to the routing substrate. Each of the patches is formed as a printed circuit board having at least one through-via and configured to communicate in the 5G spectrum operating at relative bandwidths within a given 5G spectrum of between about 8 percent and about 70 percent.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

DESCRIPTION OF ILLUSTRATIVE EMBODIMENTS

In illustrative embodiments, an active electronically steered antenna system is configured to operate at millimeter wavelengths (e.g., in the 5G spectrum) while enabling production using lower cost, easier to produce processes. To that end, various embodiments couple one or more individual patches/elements to an underlying routing substrate. Preferably, the patch component(s) and routing substrate are formed from printed circuit boards using standard printed circuit board processes and design requirements. Moreover, each of the patches/elements may be configured to communicate in the 5G spectrum operating at relative bandwidths, within a given spectrum of the 5G spectrum, of between about 8 percent and about 70 percent. Details of illustrative embodiments are discussed below.

Figure 1:
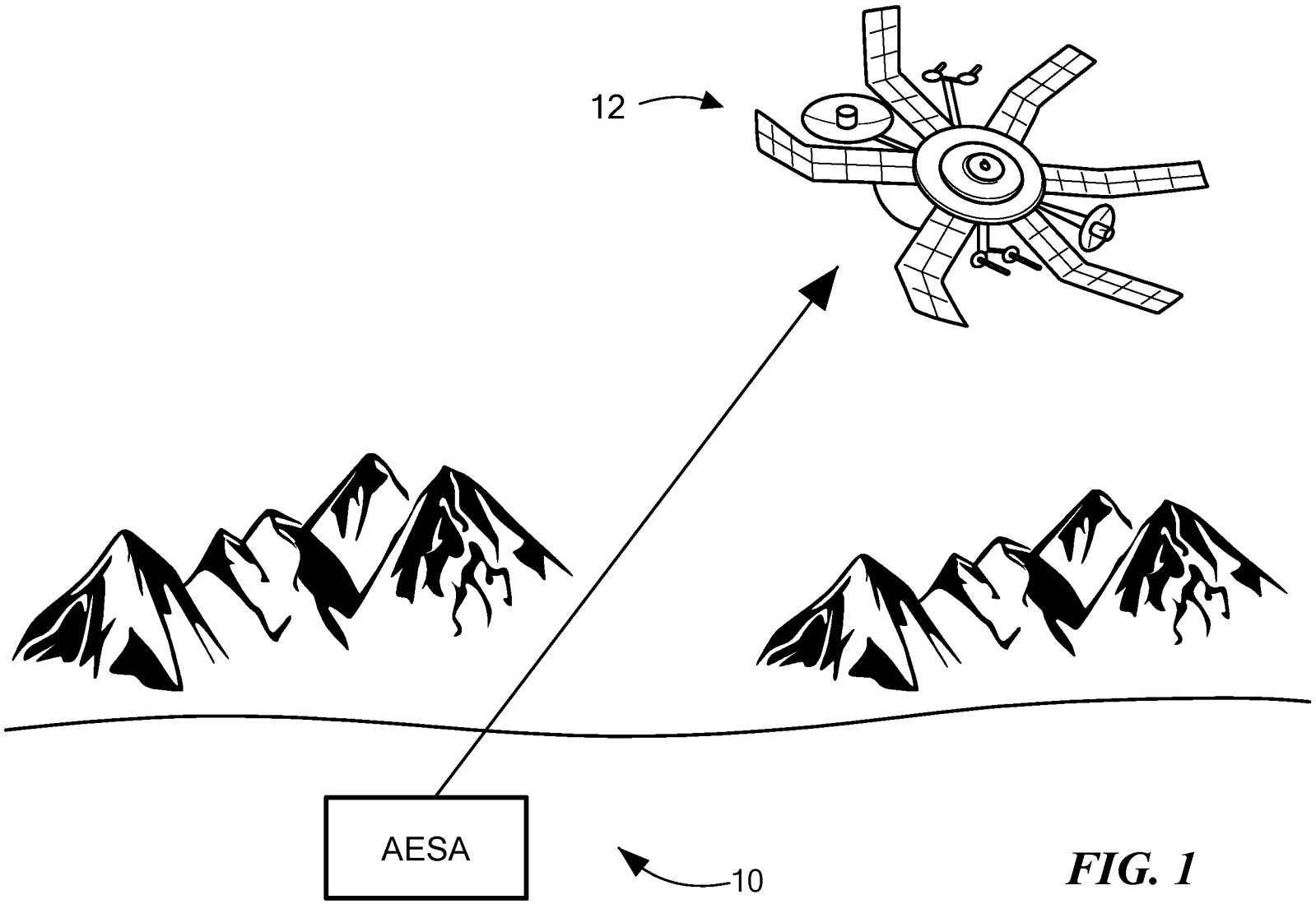
FIG. 1 schematically shows an active electronically steered antenna system ("AESA system") configured in accordance with illustrative embodiments of the invention and communicating with a satellite.

FIG. 1 schematically shows an active electronically steered antenna system ("AESA system 10") configured in accordance with illustrative embodiments of the invention and communicating with an orbiting satellite 12. A phased array (discussed below and identified by reference number "10A") implements the primary functionality of the AESA system 10. Specifically, as known by those skilled in the art, the phased array forms one or more of a plurality of electronically steerable beams that can be used for a wide variety of applications. As a satellite communication system, for example, the AESA system 10 preferably is configured operate at one or more satellite frequencies. Among others, those frequencies may include the Ka-band, Ku-band, and/or X-band.

The satellite communication system may be part of a cellular network operating under a known cellular protocol, such as the 3G, 4G, or 5G protocols. Accordingly, in addition to communicating with satellites, the system may communicate with earth-bound devices, such as smartphones or other mobile devices, using any of the 3G, 4G, or 5G protocols. As another example, the satellite communication system may transmit/receive information between aircraft and air traffic control systems. Of course, those skilled in the art may use the AESA system 10 (implementing the noted phased array 10A) in a wide variety of other applications, such as broadcasting, optics, radar, etc. Some embodiments may be configured for non-satellite communications and instead communicate with other devices, such as smartphones (e.g., using 4G or 5G protocols). Accordingly, discussion of communication with orbiting satellites 12 is not intended to limit all embodiments of the invention. Other applications include airborne and ground base stations, small cells, and customer premises equipment in 5G technology. Illustrative embodiments may be a benefit to cost sensitive solutions such as small cells and customer premises equipment. As discussed below, various embodiments provide both performance and cost effective solutions for 5G devices.

Figure 2A:
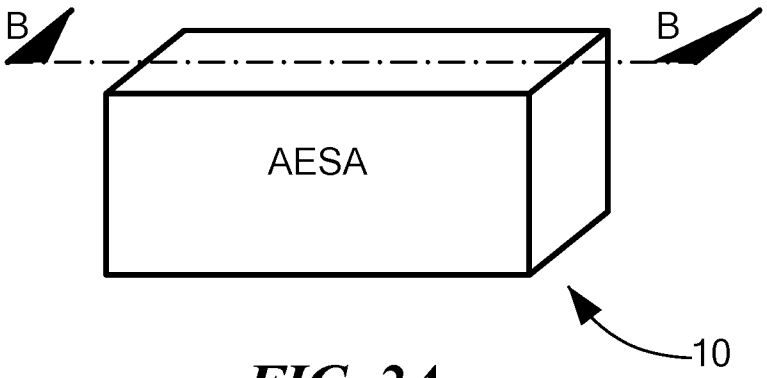
FIGS. 2A and 2B schematically show generalized diagrams of an AESA system that may be configured in accordance with illustrative embodiments of the invention.
Figure 2B:
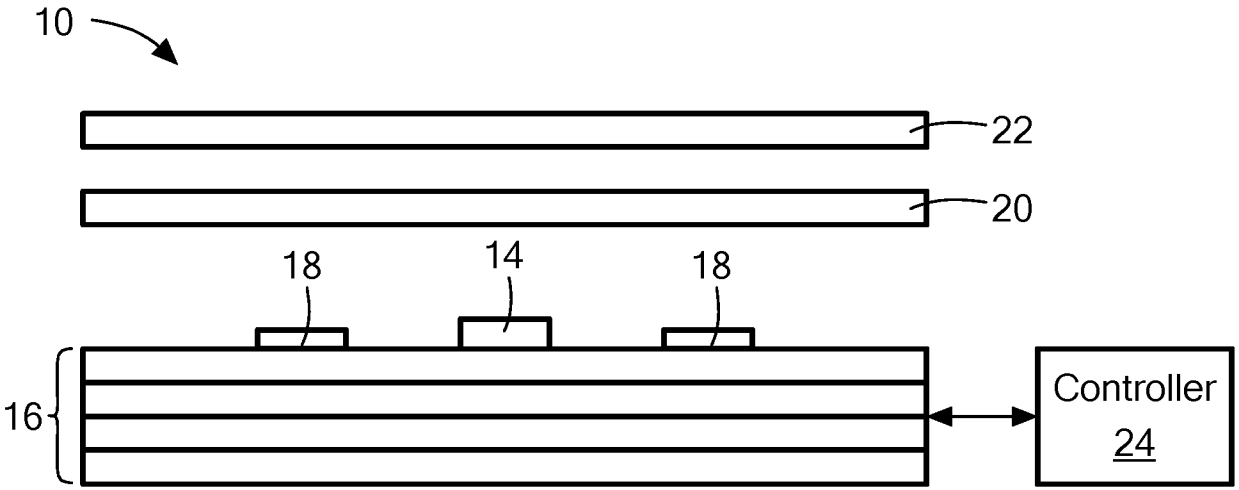

FIGS. 2A and 2B schematically show generalized diagrams of the AESA system 10 configured in accordance with illustrative embodiments of the invention. Specifically, FIG. 2A schematically shows a block diagram of the AESA system 10, while FIG. 2B schematically shows a cross-sectional view of a small portion of the same AESA system 10 across line B-B. This latter view shows a single silicon integrated circuit 14 mounted onto a substrate 16 between two transmit, receive, and/or dual transmit/receive elements 18, i.e., on the same side of a supporting substrate 16 and juxtaposed with the two elements 18. In alternative embodiments, however, the integrated circuit 14 could be on the other side/ surface of the substrate 16A. The AESA system 10 also has a polarizer 20 to selectively filter signals to and from the phased array 10A, and a radome 22 to environmentally protect the phased array of the system 10. A separate antenna controller 24 (FIG. 2B) electrically connects with the phased array to calculate beam steering vectors for the overall phased array, and to provide other control functions.

Figure 3A:
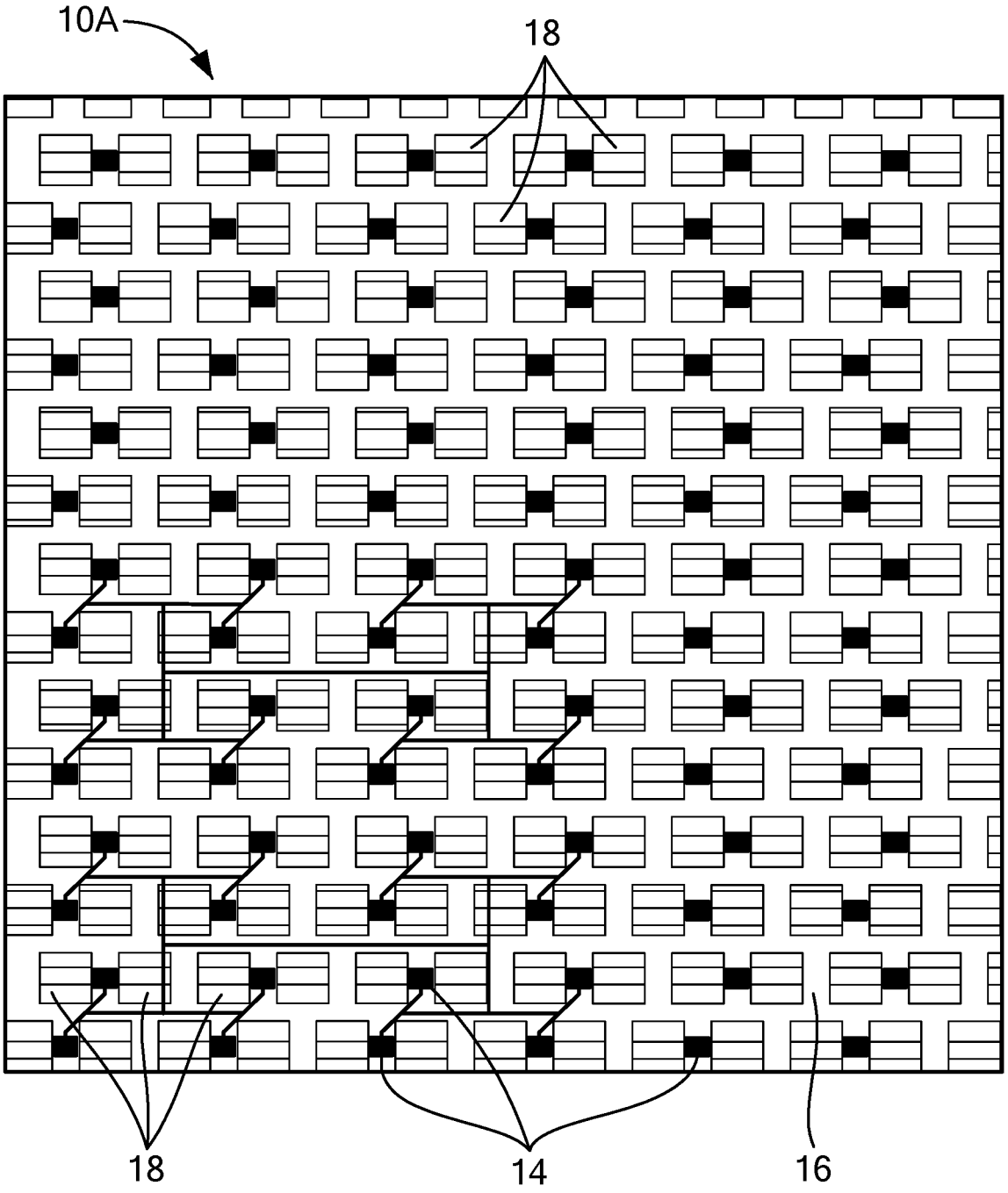
FIG. 3A schematically shows a plan view of a laminar printed circuit board portion of an AESA configured in accordance with illustrative embodiments of the invention.

FIG. 3A schematically shows a plan view of a primary portion of an AESA system 10 that may be configured in accordance with illustrative embodiments of the invention. In a similar manner, FIG. 3B schematically shows a close-up of a portion of the phased array 10A of FIG. 3A.

Specifically, the AESA system 10 of FIG. 3A is implemented as a laminar phased array 10A having a laminated printed circuit board 16 (i.e., acting as the substrate for routing signals and also identified by reference number "16") supporting the above noted plurality of elements 18 and integrated circuits 14. The elements 18 preferably are formed as a plurality of square or rectangular patch antennas oriented in a triangular patch array configuration. In other words, each element 18 forms a triangle with two other adjacent elements 18. When compared to a rectangular lattice configuration, this triangular lattice configuration requires fewer elements 18 (e.g., about 15 percent fewer in some implementations) for a given grating lobe free scan volume. Other embodiments, however, may use other lattice configurations, such as a pentagonal configuration or a hexagonal configuration. Moreover, despite requiring more elements 18, some embodiments may use a rectangular lattice configuration. Like other similar phased arrays, the printed circuit board 16 also may have a ground plane (not shown) that electrically and magnetically cooperates with the elements 18 to facilitate operation.

Figure 3B:
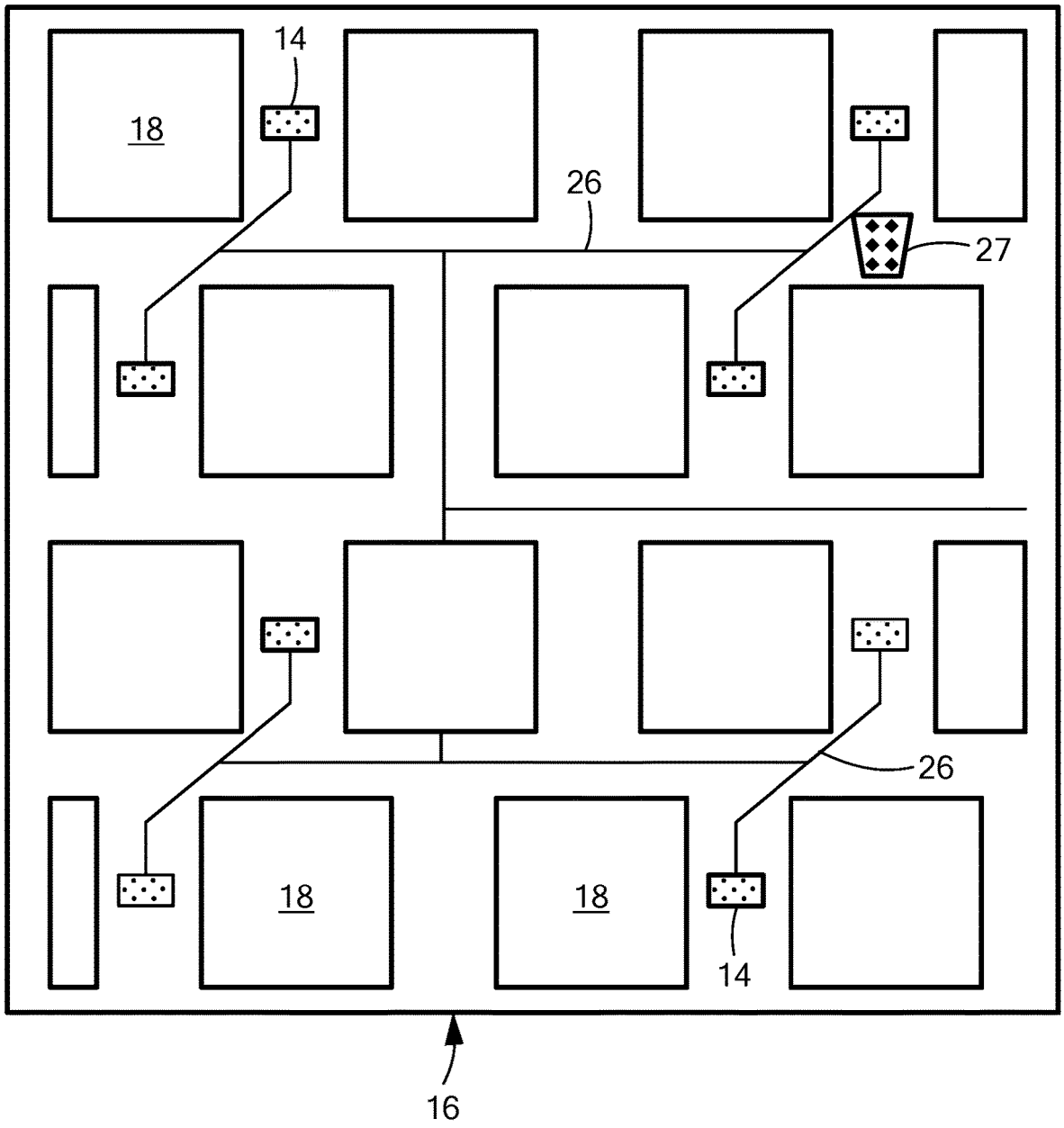
FIG. 3B schematically shows a close-up of a portion of the laminated printed circuit board of FIG. 3A.

Indeed, the array shown in FIGS. 3A and 3B is a small phased array 10A. Those skilled in the art can apply principles of illustrative embodiments to laminar phased arrays 10A with hundreds, or even thousands of elements 18 and integrated circuits 14. In a similar manner, those skilled in the art can apply various embodiments to smaller phased arrays 10A.

As a patch array, the elements 18 have a low profile. Specifically, as known by those skilled in the art, a patch antenna (i.e., the element 18 or the transmission/receiving part of the element) typically is mounted on a flat surface and includes a flat rectangular sheet of metal (known as the patch and noted above) mounted over a larger sheet of metal known as a "ground plane." A dielectric layer between the two metal regions electrically isolates the two sheets to prevent direct conduction. When energized, the patch and ground plane together produce a radiating electric field and/or receive RF signals.

As noted above and discussed in greater detail below, illustrative embodiments form the patch antennas on one or more printed circuit boards that themselves are coupled with the printed circuit board 16. These patent antennas preferably are formed using standard printed circuit board fabrication processes, thus complying with standard printed circuit board design rules (discussed below). Accordingly, using such fabrication processes, each element 18 in the phased array 10A should have a very low profile.

The phased array 10A can have one or more of any of a variety of different functional types of elements 18. For example, the phased array 10A can have transmit-only elements 18, receive-only elements 18, and/or dual mode receive and transmit elements 18 (referred to as "dual-mode elements 18"). The transmit-only elements 18 are configured to transmit outgoing signals (e.g., burst signals) only, while the receive-only elements 18 are configured to receive incoming signals only. In contrast, the dual-mode elements 18 are configured to either transmit outgoing burst signals, or receive incoming signals, depending on the mode of the phased array 10A at the time of the operation. Specifically, when using dual-mode elements 18, the phased array 10A can be in either a transmit mode, or a receive mode. The noted controller 24 at least in part controls the mode and operation of the phased array 10A, as well as other array functions.

The AESA system 10 has a plurality of the above noted integrated circuits 14 (mentioned above with regard to FIG. 2B) for controlling operation of the elements 18. Those skilled in the art often refer to these integrated circuits 14 as "beam steering integrated circuits," or "beam forming integrated circuits."

Each integrated circuit 14 preferably is configured with at least the minimum number of functions to accomplish the desired effect. Indeed, integrated circuits 14 for dual mode elements 18 are expected to have some different functionality than that of the integrated circuits 14 for the transmit-only elements 18 or receive-only elements 18. Accordingly, integrated circuits 14 for such non-dual-mode elements 18 typically have a smaller footprint than the integrated circuits 14 that control the dual-mode elements 18. Despite that, some or all types of integrated circuits 14 fabricated for the phased array 10A can be modified to have a smaller footprint.

As an example, depending on its role in the phased array 10A, each integrated circuit 14 may include some or all of the following functions:

- phase shifting,
- amplitude controlling/beam weighting,
- switching between transmit mode and receive mode,
- output amplification to amplify output signals to the elements 18,
- input amplification for received RF signals (e.g., signals received from the satellite 12), and
- power combining/ summing and splitting between elements 18.

Indeed, some embodiments of the integrated circuits 14 may have additional or different functionality, although illustrative embodiments are expected to operate satisfactorily with the above noted functions. Those skilled in the art can configure the integrated circuits 14 in any of a wide variety of manners to perform those functions. For example, the input amplification may be performed by a low noise amplifier, the phase shifting may use conventional active phase shifters, and the switching functionality may be implemented using conventional transistor-based switches.

Each integrated circuit 14 preferably operates on at least one element 18 in the array. For example, one integrated circuit 14 can operate on two or four different elements 18. Of course, those skilled in the art can adjust the number of elements 18 sharing an integrated circuit 14 based upon the application. For example, a single integrated circuit 14 can control two elements 18, three elements 18, five elements 18, six elements 18, seven elements 18, eight elements 18, etc., or some range of elements 18. Sharing the integrated circuits 14 between multiple elements 18 in this manner reduces the required total number of integrated circuits 14, correspondingly reducing the required size of the printed circuit board 16.

As noted above, the dual-mode elements 18 may operate in a transmit mode, or a receive mode. To that end, the integrated circuits 14 may generate time division diplex or duplex waveforms so that a single aperture or phased array 10A can be used for both transmitting and receiving. In a similar manner, some embodiments may eliminate a commonly included transmit/receive switch in the side arms of the integrated circuit 14. Instead, such embodiments may duplex at the element 18. This process can be performed by isolating one of the elements 18 between transmit and receive by an orthogonal feed connection.

RF interconnect, through-vias, and/or beam forming lines 26 electrically connect the integrated circuits 14 to their respective elements 18. To further minimize the feed loss, illustrative embodiments mount the integrated circuits 14 as close to their respective elements 18 as possible. Specifically, this close proximity preferably reduces RF interconnect line lengths, reducing the feed loss. To that end, each integrated circuit 14 preferably is packaged either in a flip-chipped configuration using wafer level chip scale packaging (WLCSP), or a traditional package, such as quad flat no-leads package (QFN package). While other types of packaging may suffice, WLCSP techniques are preferred to minimize real estate on the substrate 16A. Some embodiments may mount some or all of the integrated circuits 14 on or within the printed circuit boards forming the elements 18. Other embodiments may mount some or all of the integrated circuits 14 on the underlying routing substrate board 16.

In addition to reducing feed loss, using WLCSP techniques reduces the overall footprint of the integrated circuits 14, enabling them to be mounted on the top face of the printed circuit board 16 with the elements 18—providing more surface area for the elements 18.

It should be reiterated that although FIGS. 3A and 3B show the AESA system 10 with some specificity (e.g., the layout of the elements 18 and integrated circuits 14), those skilled in the art may apply illustrative embodiments to other implementations. For example, as noted above, each integrated circuit 14 can connect to more or fewer elements 18, or the lattice configuration can be different. Accordingly, discussion of the specific configuration of the AESA system 10 of FIG. 3A (and other figures) is for convenience only and not intended to limit all embodiments.

Figure 4:
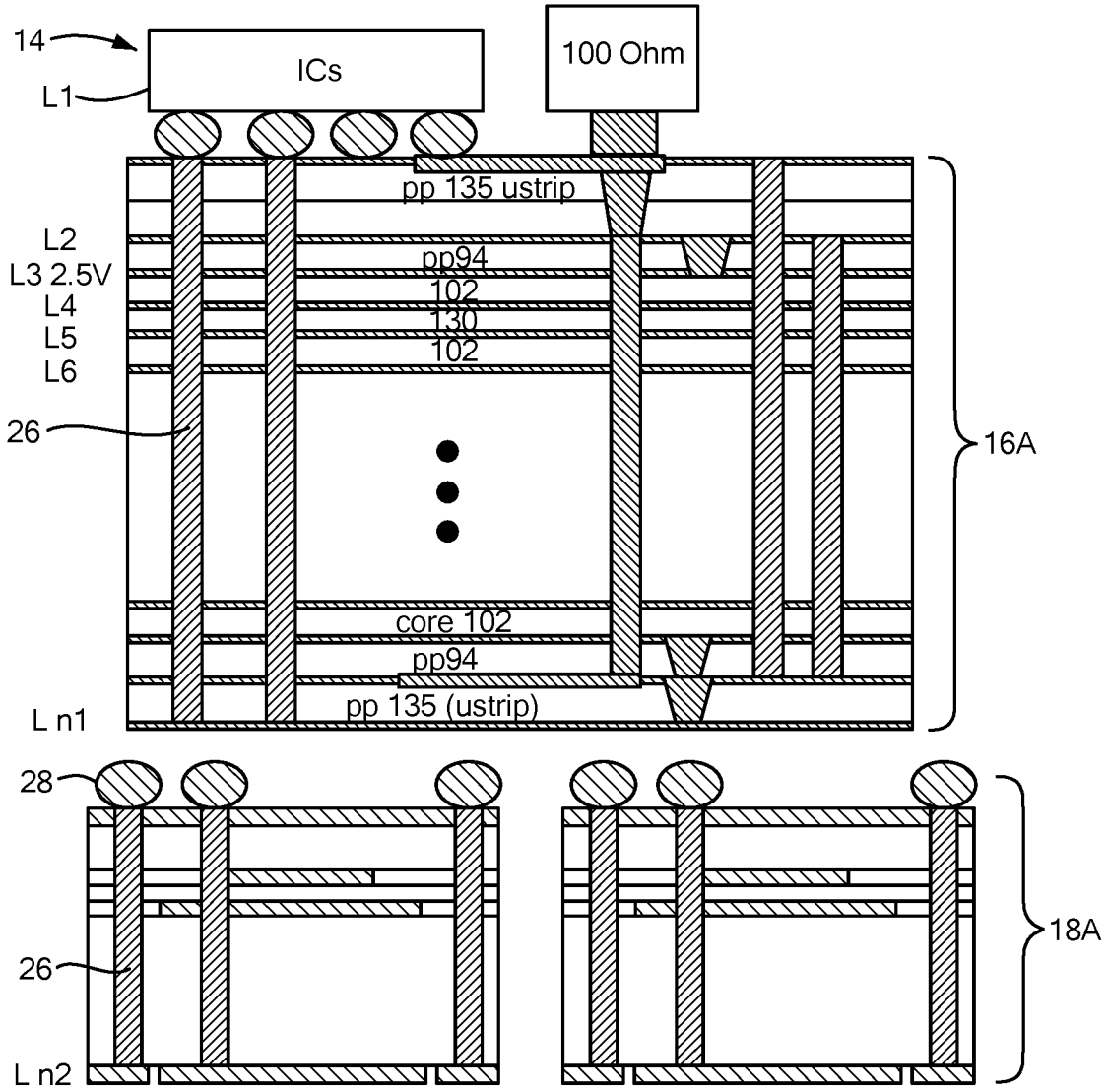
FIG. 4 schematically shows a cross-sectional view of a portion of an AESA configured in illustrative embodiments of the invention.

FIG. 4 schematically shows a partially exploded, cross-sectional view of one embodiment of the invention in which the AESA 10 has two elements 18A coupled to the substrate (referred to as the "routing substrate 16A" due to its function of routing signals to/from the elements 18A). Specifically, FIG. 4 shows the routing substrate 16A as a printed circuit board having a plurality of layers L1-Ln1 and signal routing traces and vias 26. In this example, the routing substrate 16A has through-vias 26, buried vias 26, blind vias 26, and micro-vias 26. In other embodiments, however, the routing substrate 16A is formed from standard printed circuit board processes. Also in this example, the routing substrate 16A has integrated circuits 14 and circuit elements (e.g., a 100 Ohm resistor) mounted on its back side, and the two elements 18A mounted on its front side.

In preferred embodiments, the elements 18A each have a ball grid array 28 (also referred to as a "BGA 28") for electrically and physically connecting the elements 18A with the routing substrate 16A. As noted above, each of the elements 18A preferably is configured and fabricated at the board level using standard printed circuit board fabrication processes and design rules. Table 1 below lists various design rules for standard printed circuit board fabrication processes. This is in contrast to printed circuit board fabrication processes and design rules for more enhanced technologies, such as those using high-density interconnect (HDI) fabrication processes, which typically include micro-vias and other similarly associated components.

TABLE 1

| Design Rule | Value |
|---|---|
| Minimum RF trace width | ≥0.1-0.3 mm |
| Minimum copper void (e.g. apertures) | ≥0.1-0.3 mm |
| Trace spacing | ≥0.1-0.3 mm |
| RF drill size (Diameter) | ≥0.15-0.35 mm |
| Pad size (diameter-outer layers) | ≥0.25-0.5 mm |
| Pad size (diameter-inner layers) | ≥0.3-0.5 mm |
| Minimum spacing between pads | ≥0.1 mm |
| Vias used | Plated through-vias and blind vias |
| Maximum panel size | ≥60 cm × 70 cm |

The elements 18A preferably are surface mounted to the underlying substrate 16A using conventional surface mount technologies. Exemplary ball grid arrays 28 used for surface mounting or other purposes may be sized as in Table 2 below. In other embodiments, however, one or all of the elements 18A may be mounted using other mounting/interconnect technologies, such as using through-hole mounting or other known techniques.

TABLE 2

| Nominal Ball Diameter | Reduction | Land Pattern Density Level | Nominal Land Diameter | Land Variation |
|---|---|---|---|---|
| 0.75 | 25% | A | 0.55 | 0.60-0.50 |
| 0.65 | 25% | A | 0.50 | 0.55-0.45 |
| 0.60 | 25% | A | 0.45 | 0.50-0.40 |
| 0.55 | 25% | A | 0,40 | 0.45-0.35 |
| 0.50 | 20% | B | 0.40 | 0.45-0.35 |
| 0.45 | 20% | B | 0.35 | 0.40-0.30 |
| 0.40 | 20% | B | 0.30 | 0.35-0.25 |
| 0.35 | 20% | B | 0.30 | 0.35-0.25 |
| 0.30 | 20% | B | 0.25 | 0.25-0.20 |
| 0.25 | 20% | B | 0.20 | 0.20-0.17 |
| 0.20 | 15% | C | 0.17 | 0.20-0.14 |
| 0.17 | 15% | C | 0.15 | 0.18-0.12 |
| 0.15 | 15% | C | 0.13 | 0.25-0.10 |

It should be noted that the specific layers, vias 26, and metallization in this and other figures are illustrative and not intended to limit various embodiments. Those skilled in the art may use other patterns and still conform to various embodiments of the invention. It also should be noted that like other figures, FIG. 4 is merely a schematic showing a partial cross-section of the AESA 10 and thus, the substrate 16A may extend both to the left and the right with respect to the orientation of the figure.

Figure 5A:
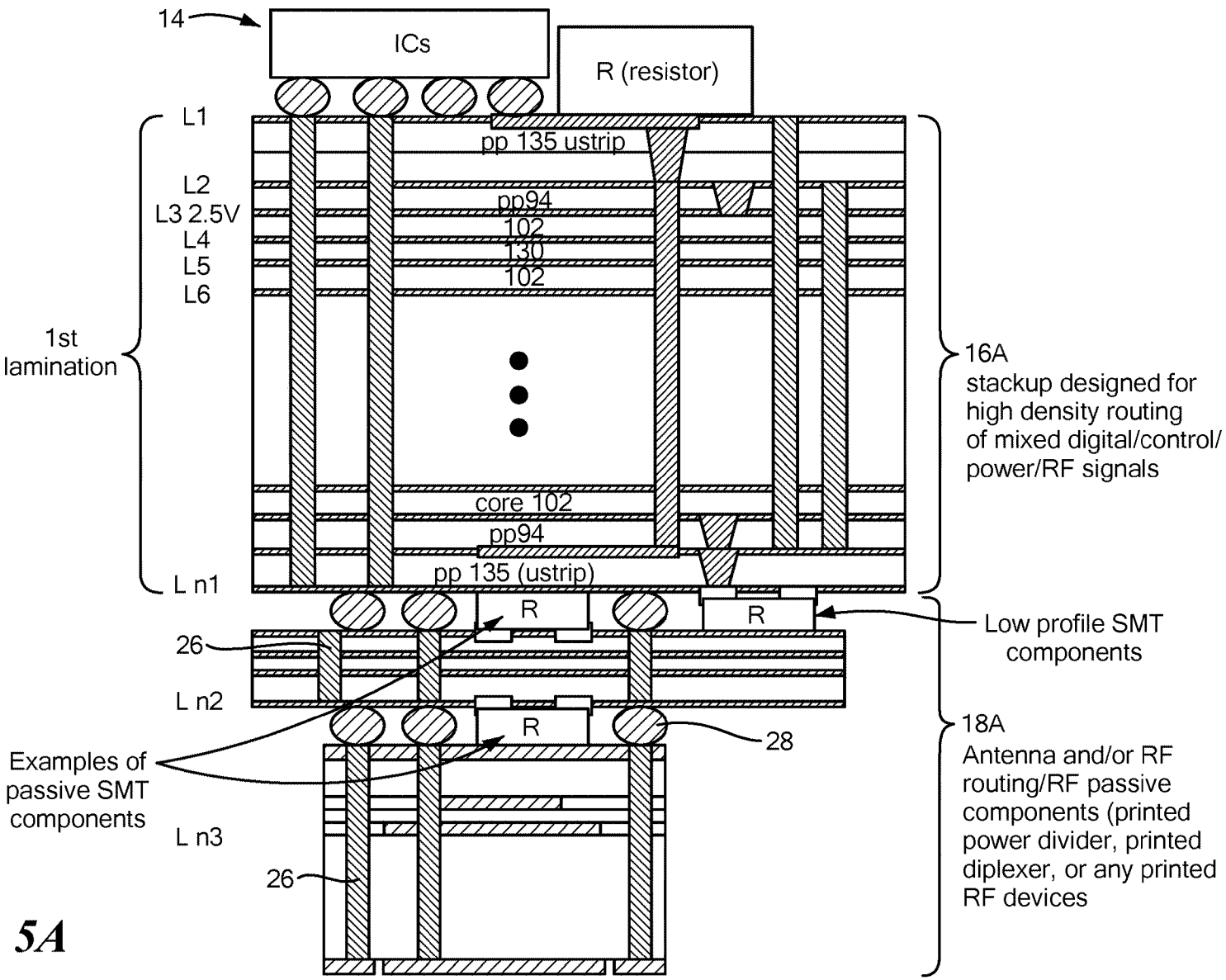
FIGS. 5A-5B schematically shows cross-sectional views of portion of an AESA in accordance with some stacked embodiments of the invention.
Figure 5B:
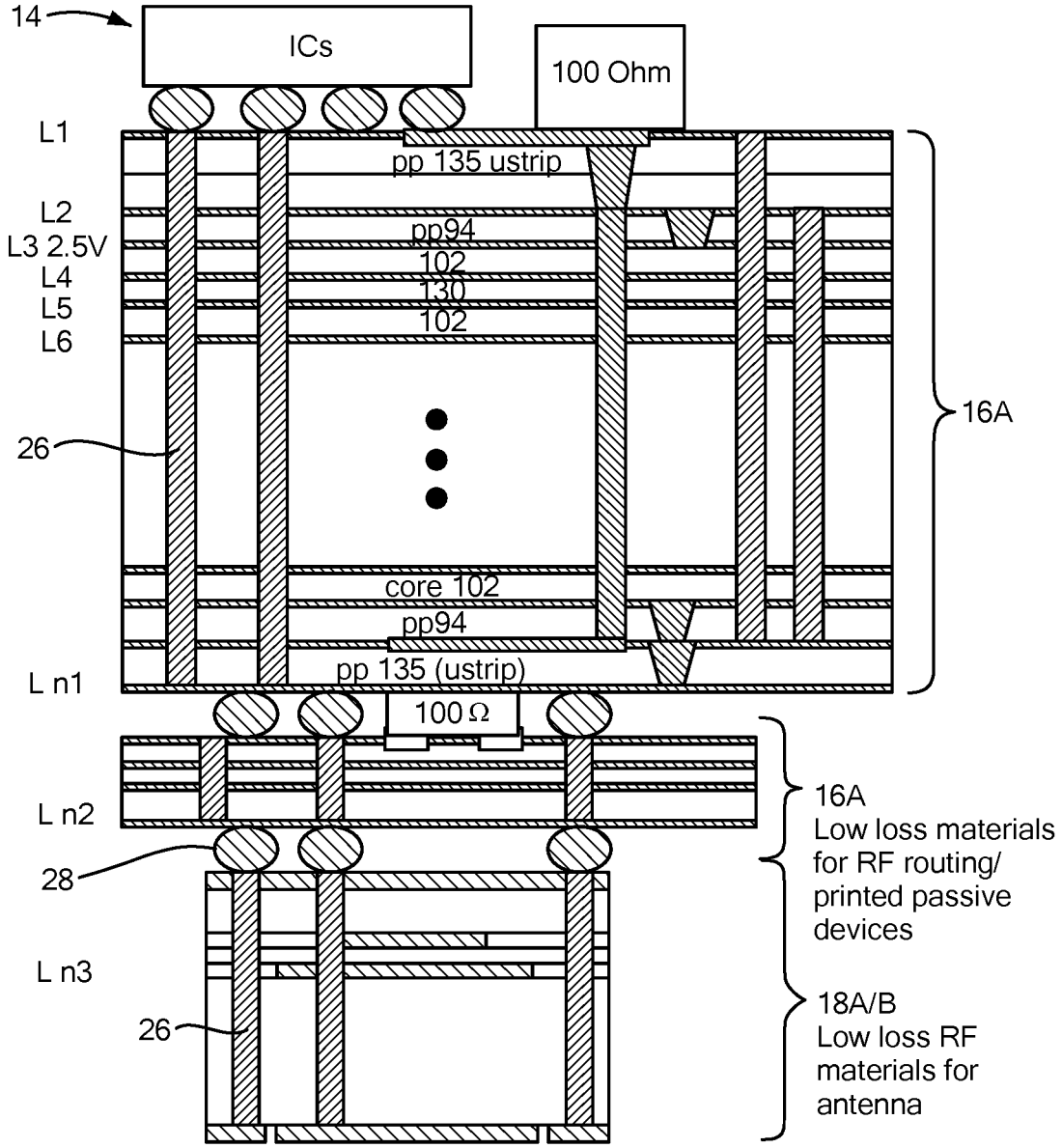

Illustrative embodiments may stack multiple printed circuit boards on the underlying substrate 16A. To that end, FIGS. 5A and 5B schematically show two examples of elements 18A stacked on the underlying substrate 16A. As shown, FIGS. 5A and 5B have an intermediate printed circuit board (either another routing substrate 16A and/or at least in part another element 18A), and an element 18A (i.e., element 18A implemented as a printed circuit board) mounted on the intermediate printed circuit board. Both the intermediate printed circuit board and the element 18A preferably are formed using standard printed circuit board processes and design rules.

As noted, illustrative embodiments also enable multiple printed circuit board stacking using ball grid arrays 28 as interfaces. With different ball grid array sizes, other surface mount technology components can be embedded in the gap between the printed circuit boards. FIGS. 5A-5B shows examples of such stacking of multiple printed circuit boards. Accordingly, various embodiments enable multiple stacked elements 18A using ball grid arrays 28 as interfaces. With different ball grid array sizes, other surface mount technology components (e.g., active and/or passive devices) can be embedded in the gap between the boards. FIGS. 5A-5B show an example of such stacking.

As known by those in the art, prior routing RF/digital/power demands a high density design in all dimensions (X, Y, and Z) for efficient layout and printed circuit board construction. For example, such a prior design may use a low BGA pitch of about 0.4 mm or smaller with small length and width spacing, many micro vias, and thin layers. Such a construction often uses high density interconnect technology ("HDI"). Elements 18A requiring a higher relative bandwidth (e.g., greater than or equal to about 8 percent and less than or equal to about 70 percent) requires asymmetrical copper layers and volumes.

Illustrative embodiments mitigate these complexities. Specifically, such embodiments use standard printed circuit board processes that comply with the requirements of Table 1. As such, these embodiments used in the AESA space may use through-via PCB processes, as well as PCB on PCB integration with ball grid arrays 28 of different sizes configured to support 5G millimeter wave antennas for low cost scalable large size boards and large relative bandwidth. This illustrative process also uses non-HDI, standard length/width spacing, no micro-vias, and a relatively large BGA pitch (>0.5 mm). Different types of patch antennas (e.g., stacked patch with pin/probe fed or proximity fed or aperture couple/slot fed) can be designed/built with a single through-vias 26 using cut-out in the patches (discussed below). The through-via 26 can carry an antenna signal and has a stub.

Prior art designs with integrated elements and substrates known to the inventors often have 20 or more layers. Those layers, however, may be split between the substrate 16A and the elements 18A. For example, rather than a single 20 layer design, illustrative embodiments may have a substrate 16A with 16 layers and elements 18A with 4 layers. As one skilled in the art may understand, the latter design is significantly simplified and thus, less costly despite having a same number of layers. The inventors discovered that the extra step of mounting the element 18A and the substrate 16A still does not increase the complexity and its cost still generally is less than that of a single, unitary integrated design.

In addition to single layer antennas, some embodiments may use stacked patch/element designs. As known by those in the art, such a design has two patch layers spaced apart in the Z-direction (relative to the substrate 16A) and separated by an insulator. Accordingly, the two patch layers are electrically isolated. One patch layer may be coupled with ground or circuitry using a via 26 or other connector, while the other patch layer electrically floats. Using this configuration, the uncoupled patch layer parasitically couples with the other patch layer to act as a filter to control resonances.

Figure 6:
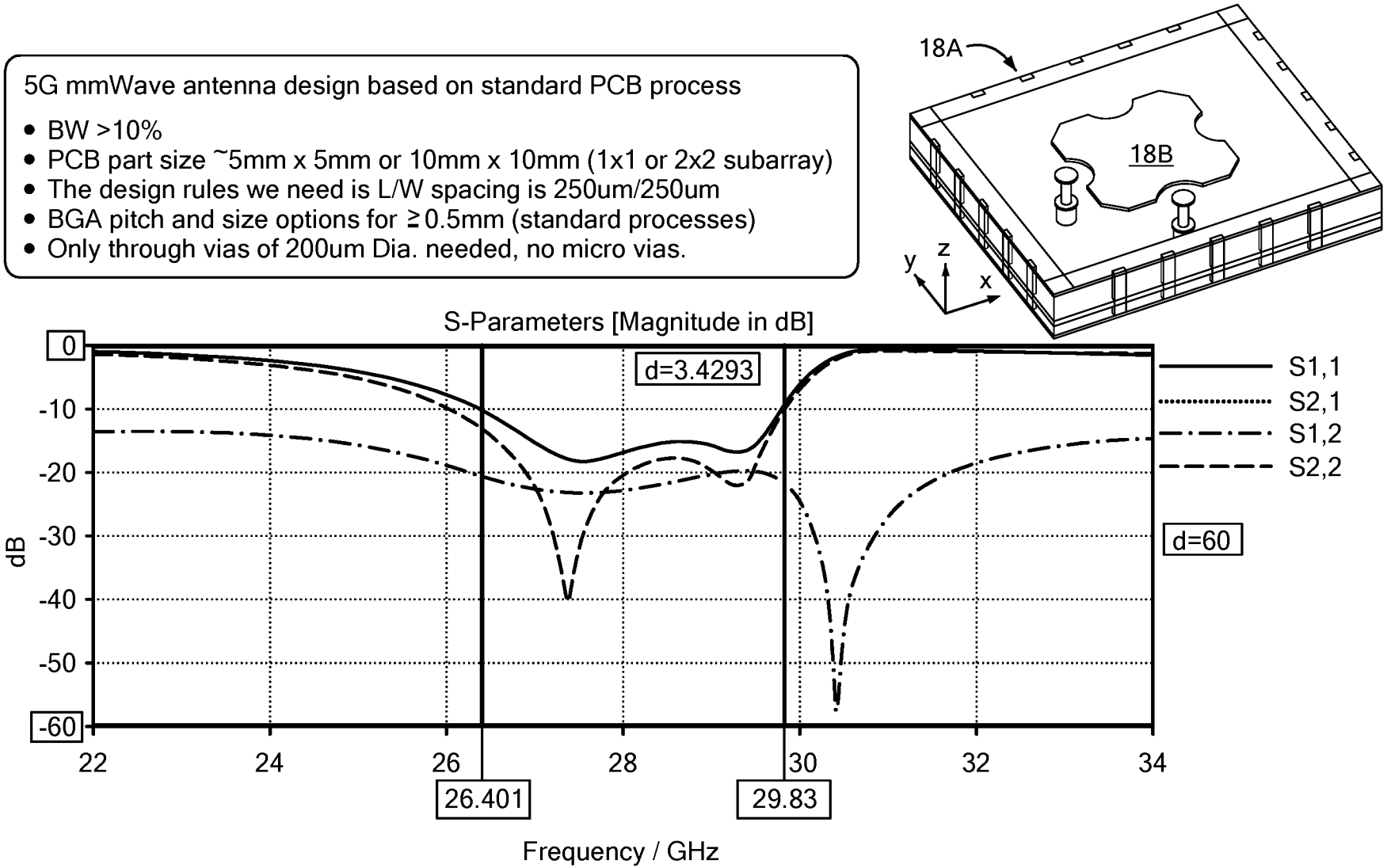
FIG. 6 schematically shows a waveform showing performance of an exemplary embodiment of a 5G mm wave antenna using a standard printed circuit board process in illustrative embodiments.

The embodiment of FIG. 6 includes an element 18A as a stacked patch design. Specifically, this figure shows the well-known S-Parameters in dB as a function of frequency in this example. The exemplary 5G millimeter wave antenna design using standard printed circuit board processes is detailed in the figure.

Figure 7A:
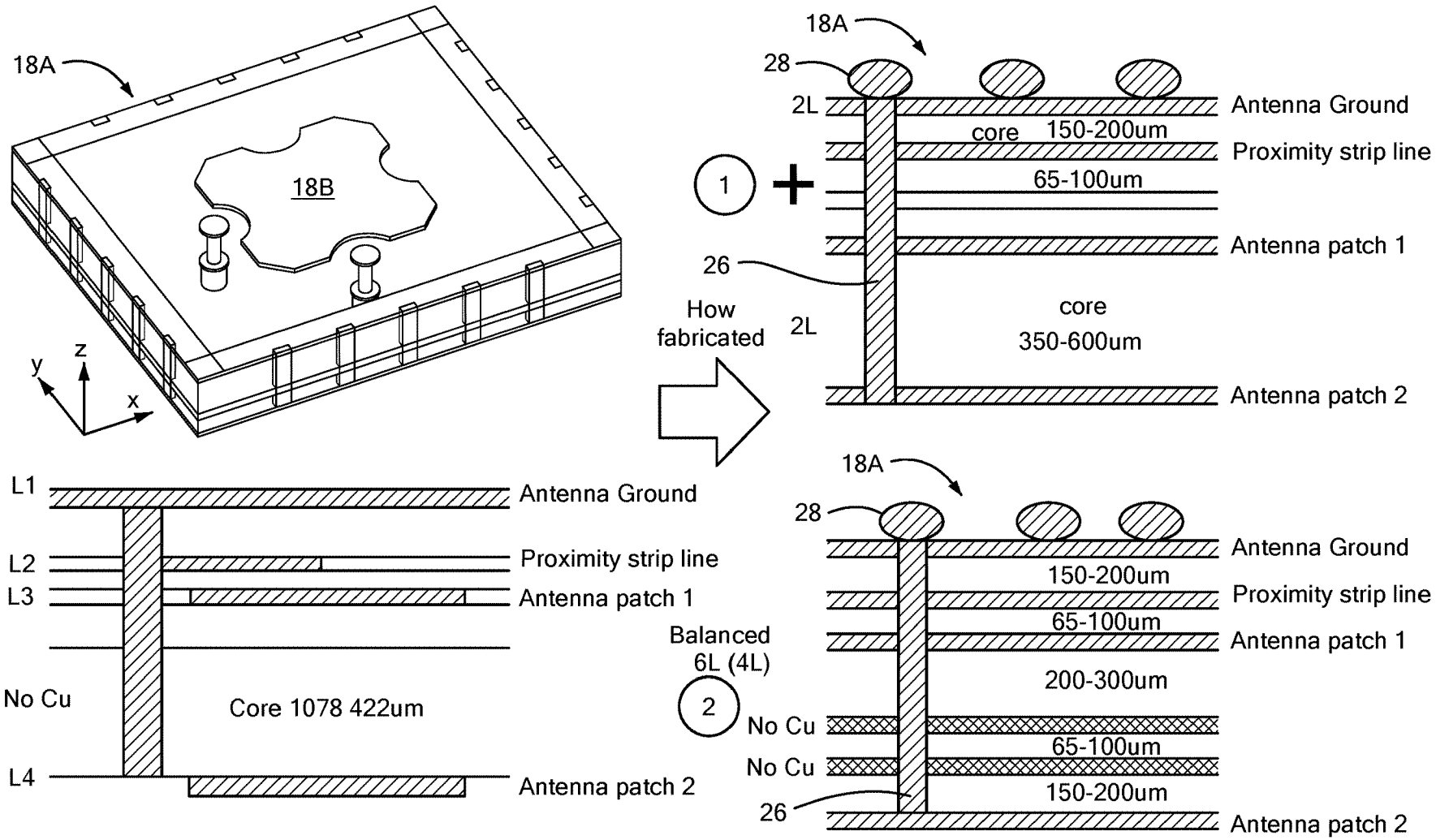
FIGS. 7A-7C schematically show three embodiments in accordance with illustrative embodiments of the invention.
Figure 7B:
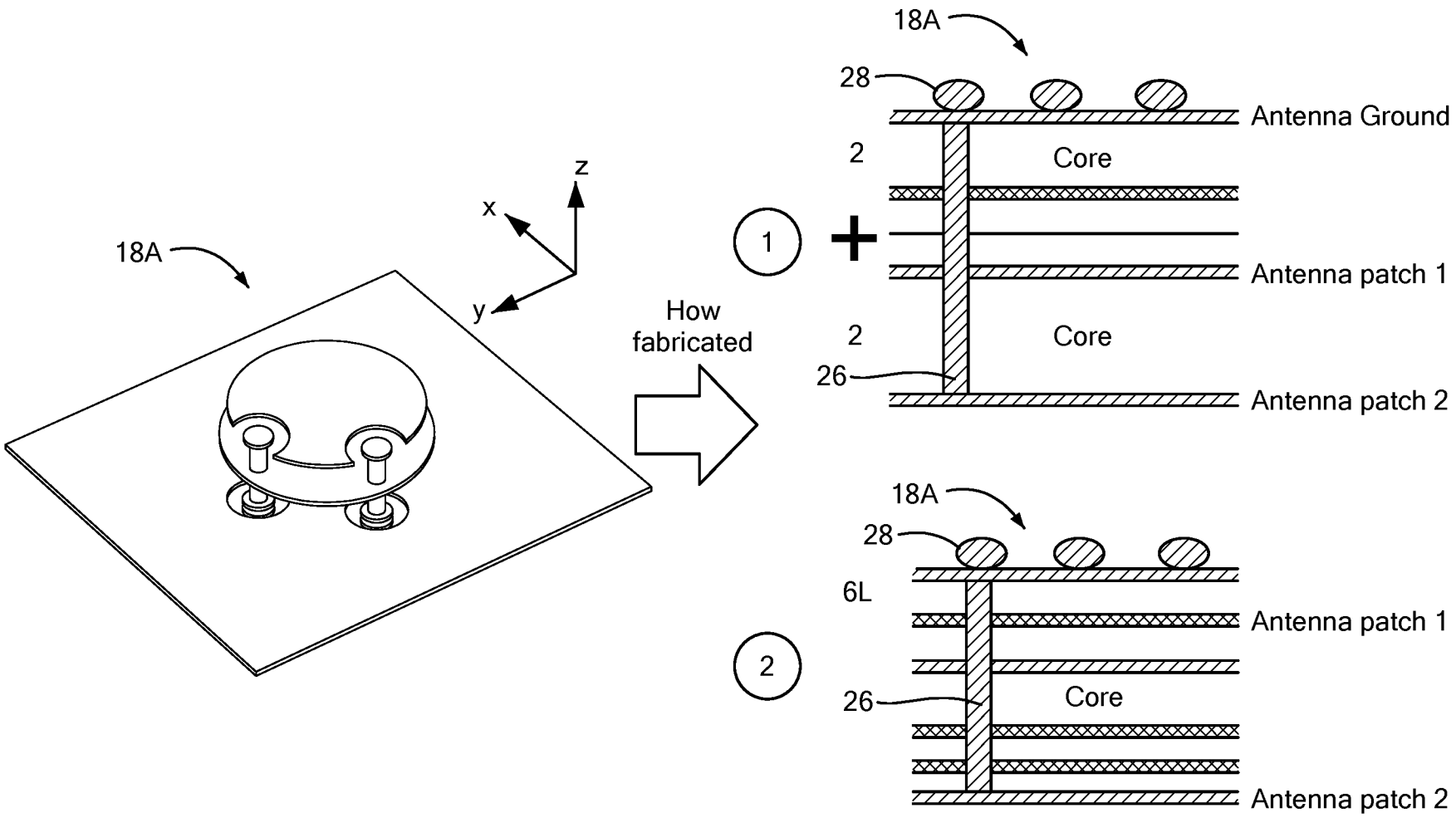
Figure 7C:
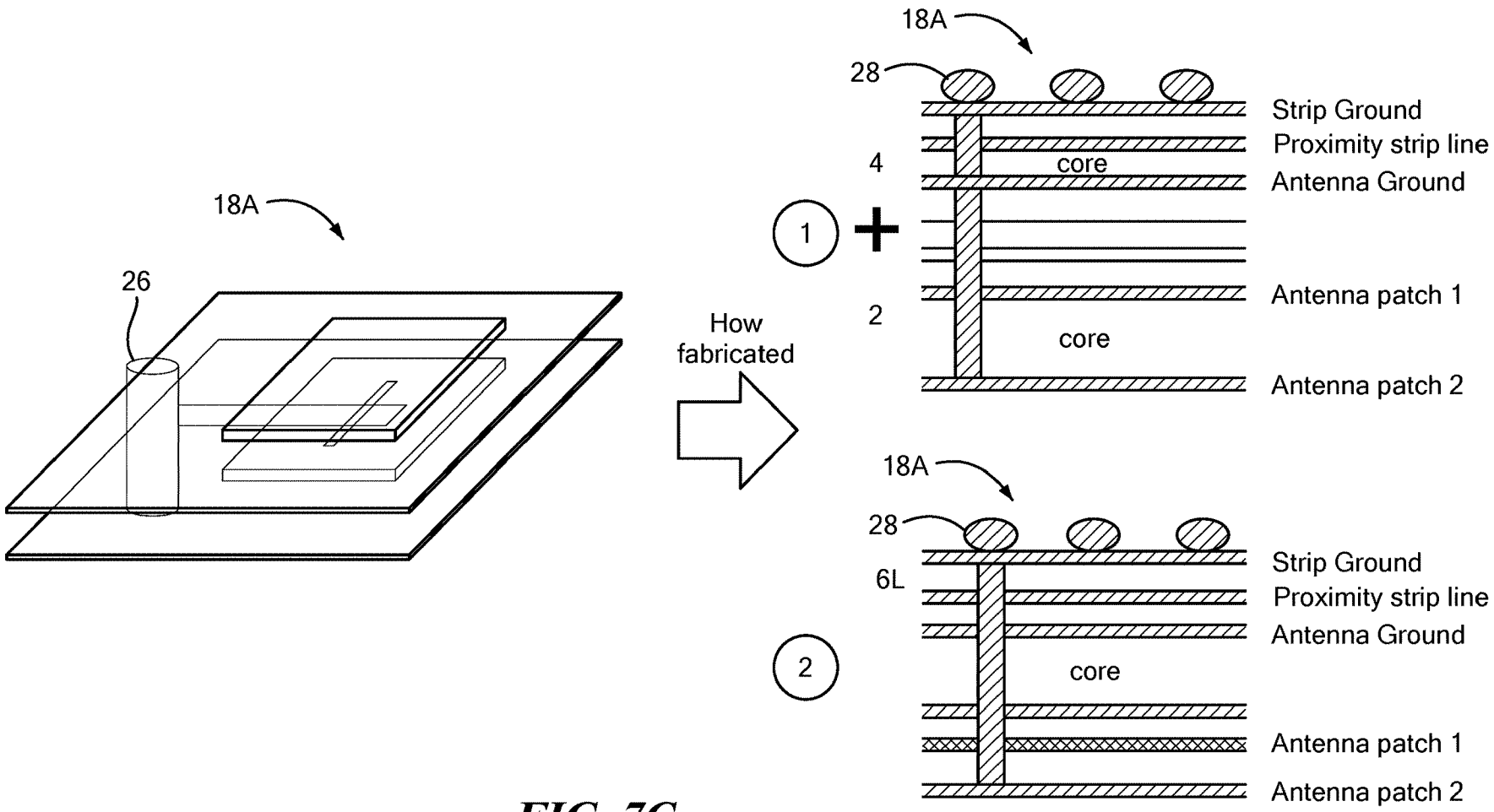

FIGS. 7A-7C schematically show three stacked embodiments of the patch/element 18A configured in accordance with illustrative embodiments of the invention. FIGS. 7A and 7B teach stacked patches 18A with notches, while FIG. 7C shows a stacked design with no notches. The fabrication of these is shown in steps 1 and 2 on the right side of the figures. Preferred embodiments produce these elements 18A in a balanced manner. Note that certain layers are called out in these figures (e.g., "antenna ground" and "antenna patch 1") as well as layer thicknesses. Note that these designations are illustrative and not intended to limit other embodiments of the invention.

To this point in this discussion, the term "element 18A" has been loosely used to describe the printed circuit board component used as a patch or antenna mounted to the substrate 16A. The element 18A also has been generally described as having one or more antennas 18B and even has been referred to as an antenna 18B. FIGS. 8-9B clarify this by refining the term "element 18A" or "patch 18A" to generally comprise the mountable portion. This mountable portion may have one or more antennas 18B; namely, metal layers integrated into the printed circuit board forming the element 18A or patch 18A. In fact, as noted above, these elements 18A or patches 18A may include other circuit elements, such as the integrated circuits 14, active, passive and other circuit devices, which may be mounted on their surfaces or embedded within the element layers.

Figure 8A:
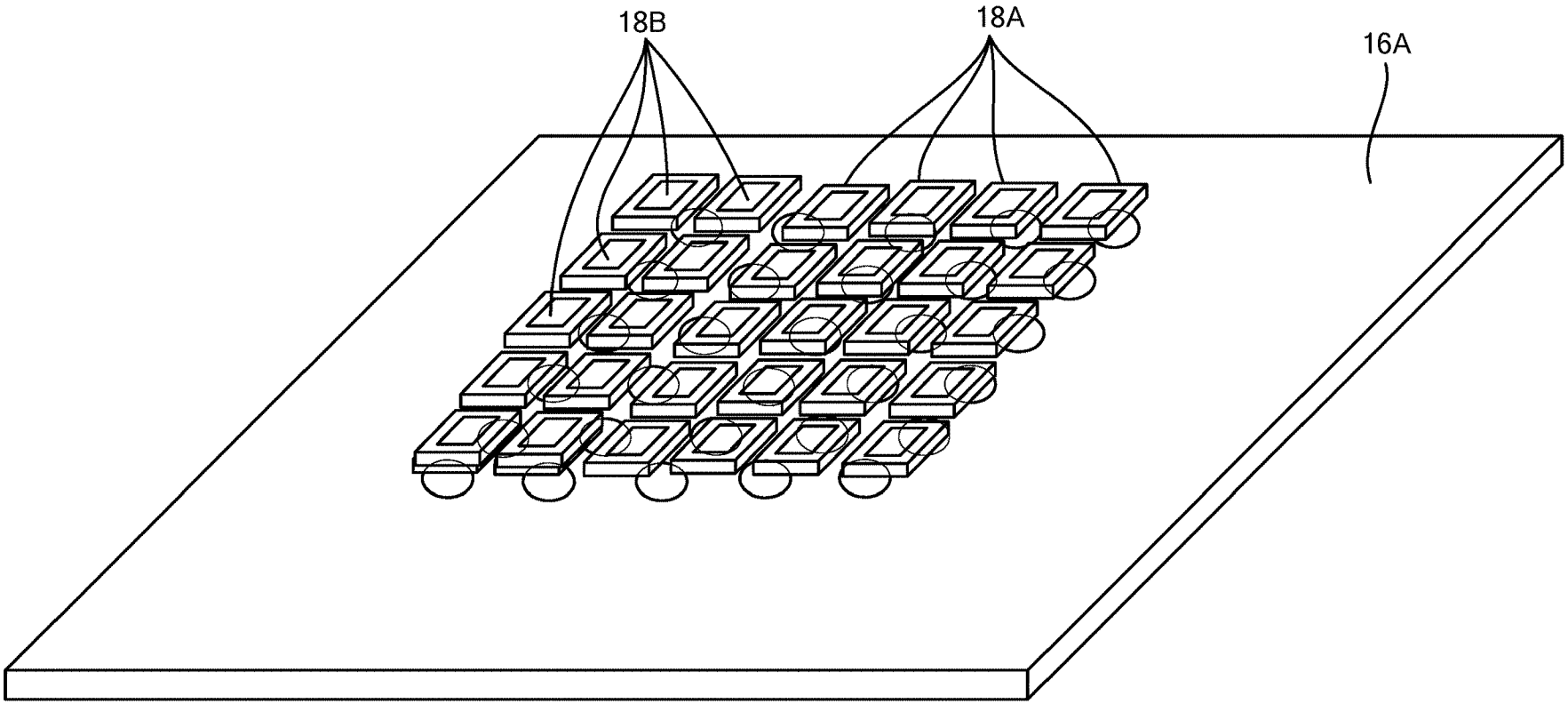
FIG. 8A schematically shows an embodiment of the invention in which each individual coupled component has one antenna element.

FIG. 8A therefore schematically shows one example in where each patch/element 18A has a single antenna 18B on its top surface. This six-by-five array of patches 18A is secured to the substrate 16A using any of the above noted processes. Additionally, this array configuration can be changed from system to system and reuse the single element 18A as its lattice unit. Therefore, different lattices (e.g., triangular or rectangular in different sizes) can be constructed using the same element 18A.

Figure 8B:
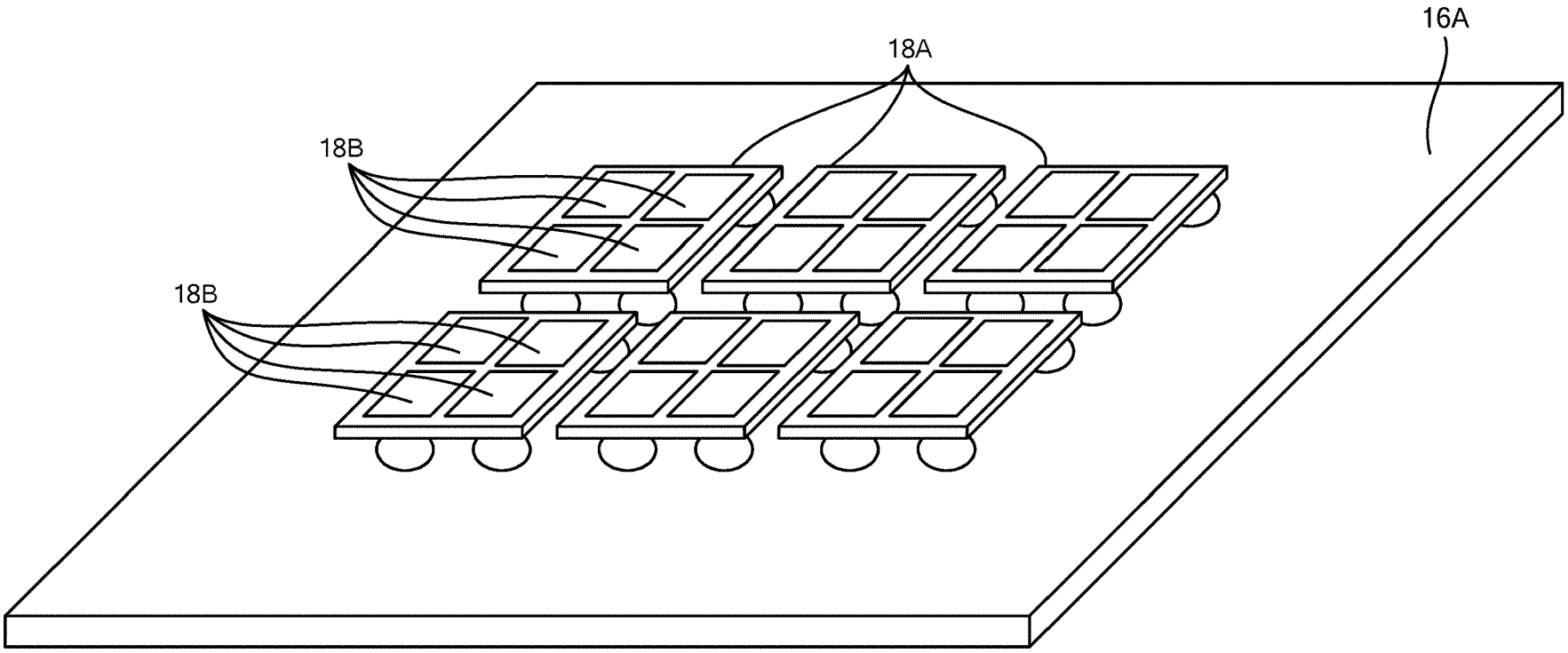
FIG. 8B schematically shows another embodiment of the invention with elements having multiple antennas.

FIG. 8B schematically shows another embodiment with an array of elements 18A that each have a sub-array of antennas 18B. Each subarray of antennas can be grouped into a 2×2 array, or any subarray size and allow the array lattice to be reconfigured based on this subarray unit. One benefit of this design is that it integrates routing into the subarray unit, which can simplify the system integration and multifunctional scaling.

Figure 9A:
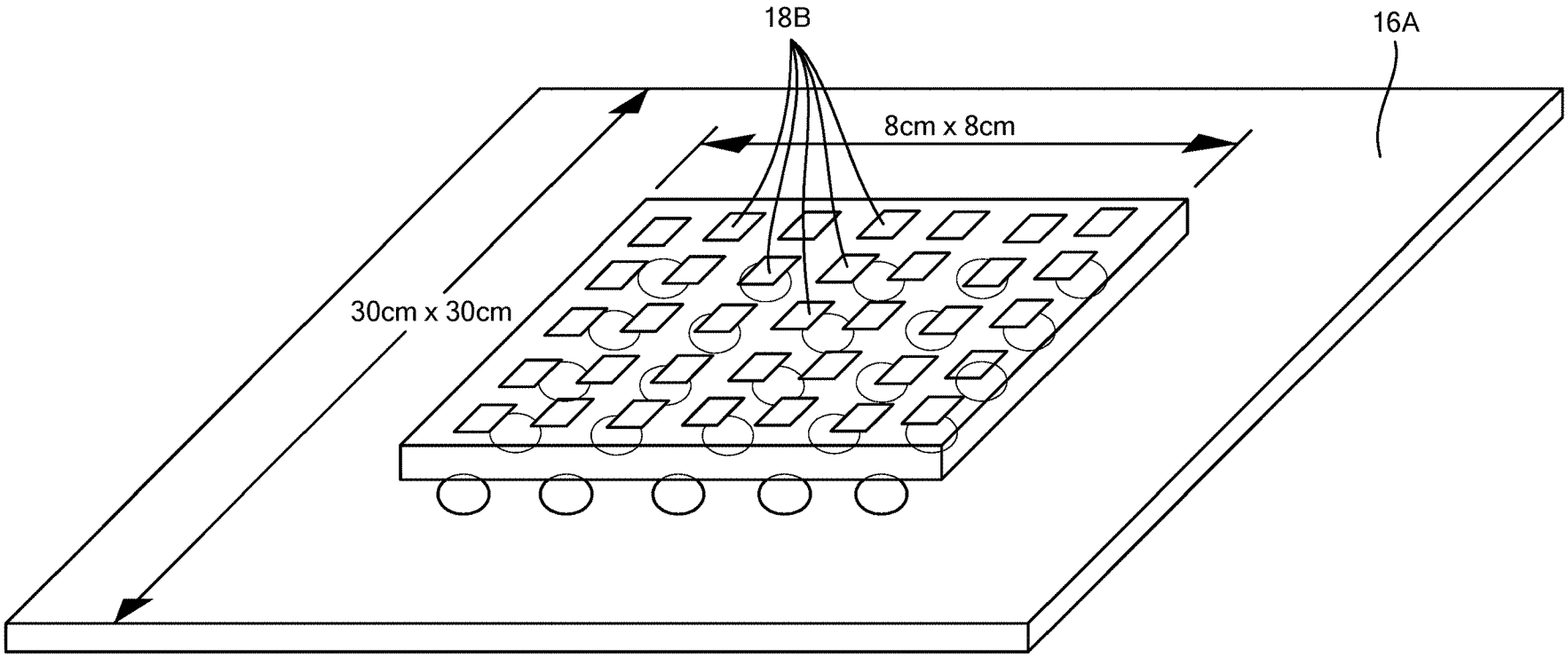
FIGS. 9A and 9B schematically show examples of an embodiment of the invention in which each individual coupled component has a plurality of antenna elements.
Figure 9B:
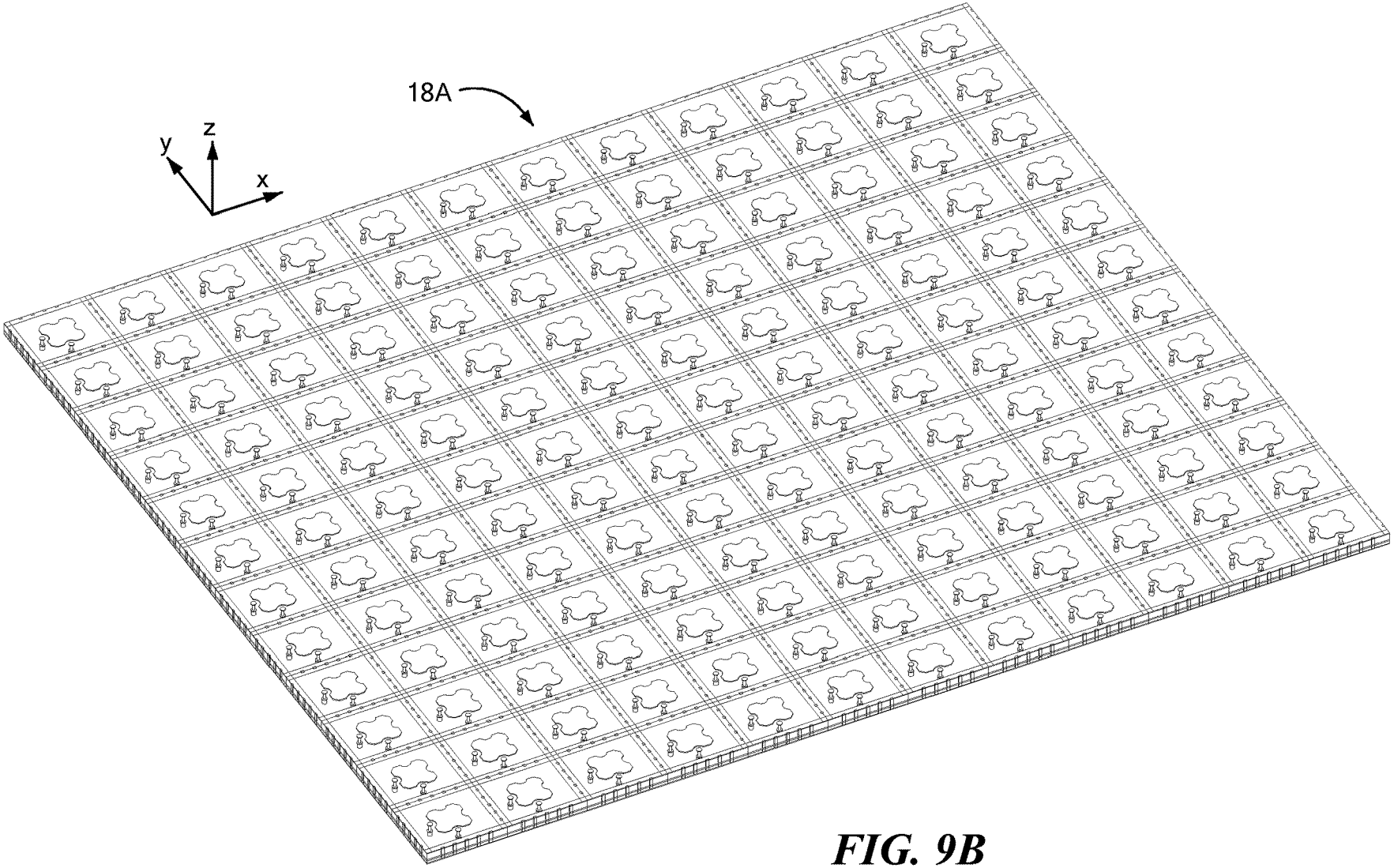

In contrast, FIGS. 9A and 9B schematically show another embodiment in which a single patch 18A with a plurality of antennas 18B is mounted to the substrate 16A. In this case, the single patch 18A has a seven-by-five array of antennas 18B on its top surface. The single patch 18A can have a smaller surface area than that of the substrate 16A. In this example, the patch 18A has a size of about 8 cm by 8 cm, while the substrate 16A has a size of about 30 cm by 30 cm. Other embodiments may extend the patch 18A to have a same or similar size as that of the substrate 16A. Some embodiments may mix and match the embodiments of FIGS. 8A-9B, such as using more than one multi-antenna patch 18A of FIG. 9A, or those using both types of patches 18A of FIGS. 8 and 9A.

Figure 10:
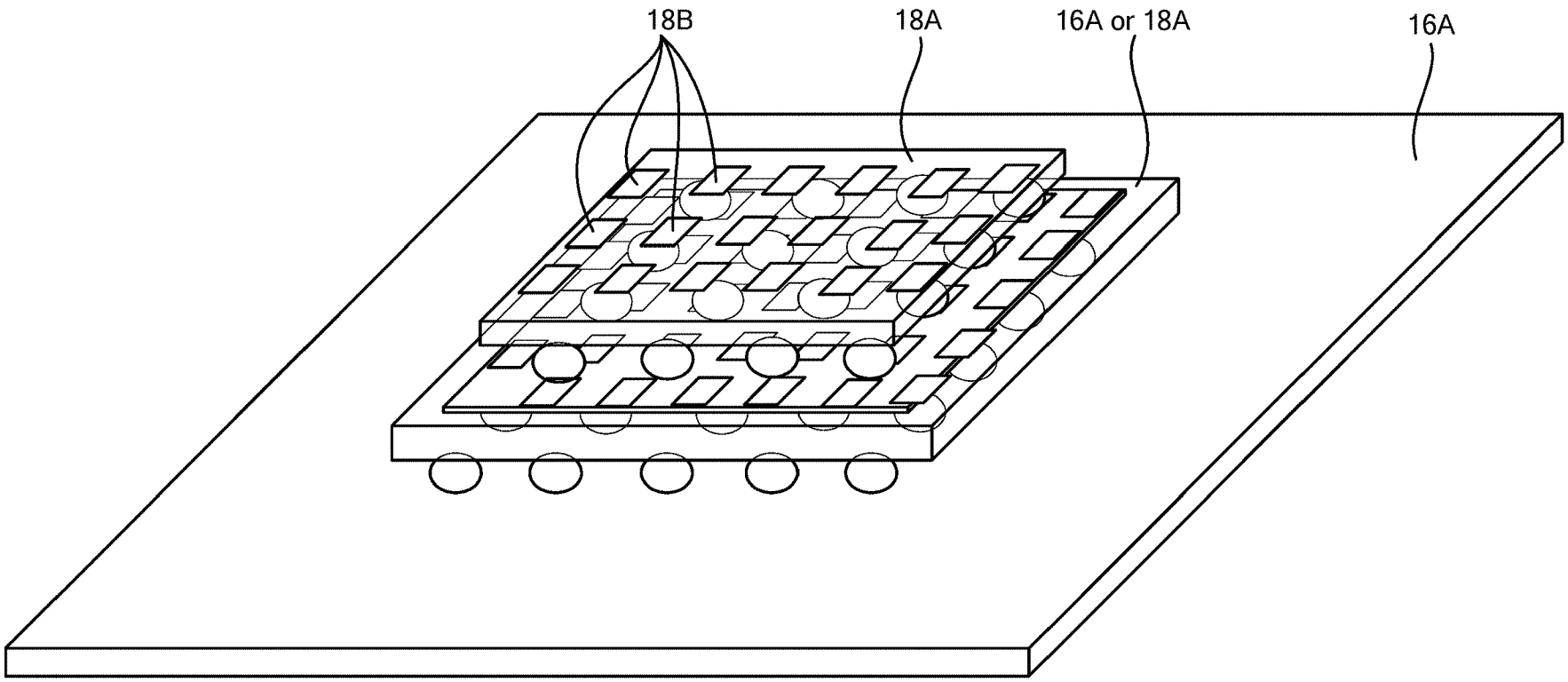
FIG. 10 schematically shows an embodiment of the invention with stacked components.

FIG. 10 schematically shows a stacked embodiment similar to that of FIG. 5A. In a manner similar to the embodiment of FIG. 9A, this embodiment has a single patch 18A with a plurality of antennas 18B. In this example, the intermediate board 16A or 18A may be the same size, larger, or smaller than that of the top patch.

Accordingly, using board level processes, illustrative embodiments provide a simplified, balanced AESA design that avoids warping and yet, is robust with capability to operate as 5G millimeter wave antennas 18B. Such a design also should improve fabrication yields and enhance the degree of freedom for the design when selecting material choice and stack-up for various antenna concepts. In illustrative embodiments, no micro-vias are required for the elements/patches 18A and line routing is simplified.

Various embodiments of the present invention may be characterized by the potential claims listed in the paragraphs following this paragraph (and before the actual claims provided at the end of the application). These potential claims form a part of the written description of the application. Accordingly, subject matter of the following potential claims may be presented as actual claims in later proceedings involving this application or any application claiming priority based on this application. Inclusion of such potential claims should not be construed to mean that the actual claims do not cover the subject matter of the potential claims. Thus, a decision to not present these potential claims in later proceedings should not be construed as a donation of the subject matter to the public. Nor are these potential claims intended to limit various pursued claims.

Without limitation, potential subject matter that may be claimed (prefaced with the letter "P" so as to avoid confusion with the actual claims presented below) includes:

P1. A patch array comprising:
- a routing substrate having a plurality of layers for routing signals;
- a plurality of patches formed as printed circuit boards having at least one through-via and surface mounted with the routing substrate,
- each of the patches being configured to communicate in the 5G spectrum operating at relative bandwidths, within a given spectrum of the 5G spectrum, of between about 8 percent and about 70 percent.

P2. The patch array of innovation P1 wherein the relative bandwidths are between about 24 GHz and 49 GHz.

P3. The patch array of one or more of the above innovations wherein the plurality of patches are surface mounted to the routing substrate using a ball grid array.

P4. The patch array of one or more of the above innovations wherein the given spectrum has a highest frequency and a lowest frequency, the relative bandwidth being the difference between the highest and lowest frequencies divided by the midpoint frequency between the highest and lowest frequencies.

P5. The patch array of one or more of the above innovations wherein the routing substrate has standard vias.

P6. The patch array of one or more of the above innovations wherein the routing substrate and the plurality of patches are free of micro-vias.

P7. The patch array of one or more of the above innovations wherein the plurality of patches includes one or more stacked patches.

P8. The patch array of one or more of the above innovations wherein a set of the plurality of patches each have a plurality of antennas.

P9. The patch array of one or more of the above innovations wherein a set of the plurality of patches includes a stacked patch.

P10. A method of forming a patch array, the method comprising:

providing a routing substrate having a plurality of layers for routing signals;

coupling a plurality of PCB patches to the routing substrate, each of the patches being configured to communicate in the 5G spectrum operating at relative bandwidths, within a given spectrum of the 5G spectrum, of between about 8 percent and about 70 percent.

P11. The method of innovation P10 wherein the relative bandwidths are between about 24 GHz and 49 GHz.

P12. The method of one or more of innovations P10-P11 wherein the plurality of patches are surface mounted to the routing substrate with a ball grid array.

P13. The method of one or more of innovations P10-P12 wherein the given spectrum has a highest frequency and a lowest frequency, the relative bandwidth being the difference between the highest and lowest frequencies divided by the midpoint frequency between the highest and lowest frequencies.

P14. The method of one or more of innovations P10-P13 wherein the routing substrate has standard vias.

P15. The method of one or more of innovations P10-P14 wherein the routing substrate and the plurality of patches are free of micro-vias.

P16. The method of one or more of innovations P10-P15 wherein the plurality of patches includes one or more stacked patches.

P17. The method of one or more of innovations P10-P16 further comprising using standard printed circuit board fabrication processes to produce the plurality of patches.

P18. The method of one or more of innovations P10-P17 wherein each of the plurality of patches comprises a plurality of antennas.

P19. The patch array of one or more of innovations P10-P18 wherein a set of the plurality of patches are formed on a single printed circuit board.

P20. The patch array of one or more of innovations P10-P19 wherein a set of the plurality of patches includes a stacked patch.

P21. The patch array of one or more of innovations P10-P20 wherein a set of the plurality of patches are produced using standard printed circuit board processes.

P22. A patch array comprising:

a routing printed circuit board having a plurality of layers for routing signals;

a plurality of printed circuit board patches having at least one through-via and mounted with the routing printed circuit board, the plurality of printed circuit board patches being formed in compliance with standard printed circuit board rules.

P23. The patch array of innovation P22 wherein each of the patches is configured to communicate in the 5G spectrum operating at relative bandwidths, within a given spectrum of the 5G spectrum, of between about 8 percent and about 70 percent.

P24. The patch array of any one or more of innovations P22-P23 wherein the relative bandwidths are between about 24 GHz and 49 GHz.

P25. The patch array of any one or more of innovations P22-P24 wherein the plurality of patches are surface mounted to the routing substrate using a ball grid array.

P26. The patch array of any one or more of innovations P22-P25 wherein the given spectrum has a highest frequency and a lowest frequency, the relative bandwidth being the difference between the highest and lowest frequencies divided by the midpoint frequency between the highest and lowest frequencies.

P27. The patch array of any one or more of innovations P22-P26 wherein the routing substrate has standard vias.

P28. The patch array of any one or more of innovations P22-P27 wherein the routing printed circuit board and the plurality of patches are free of micro-vias.

P29. The patch array of any one or more of innovations P22-P28 wherein the plurality of patches includes one or more stacked patches.

P30. The patch array of any one or more of innovations P22-P29 wherein a set of the plurality of patches each have a plurality of antenna elements.

P31. The patch array of any one or more of innovations P22-P30 wherein a set of the plurality of patches includes a stacked patch.

The embodiments of the invention described above are intended to be merely exemplary; numerous variations and modifications will be apparent to those skilled in the art. Such variations and modifications are intended to be within the scope of the present invention as defined by any of the appended innovations.

What is claimed is:

1. A patch array comprising:

a routing substrate having a plurality of layers for routing signals;

a plurality of printed circuit board (PCB) patches, each PCB patch having at least one through-via and surface mounted to the routing substrate, each of the PCB patches comprising communication circuitry configured to communicate in the 5G spectrum operating at relative bandwidths, within a given spectrum of the 5G spectrum, of between about 8 percent and about 70 percent, wherein the routing substrate and the PCB patches are printed circuit boards fabricated at the board level using standard printed circuit board fabrication processes and design rules.

2. The patch array of claim 1, wherein the relative bandwidths are between about 24 GHz and 49 GHz.

3. The patch array of claim 1, wherein each PCB patch is surface mounted to the routing substrate using a ball grid array.

4. The patch array of claim 1, wherein the given spectrum has a highest frequency and a lowest frequency, the relative bandwidth being the difference between the highest and lowest frequencies divided by the midpoint frequency between the highest and lowest frequencies.

5. The patch array of claim 1, wherein the routing substrate has standard vias.

6. The patch array of claim 1, wherein the routing substrate and the plurality of PCB patches are free of micro-vias.

7. The patch array of claim 1, wherein at least one of the PCB patches is a stacked patch.

8. The patch array of claim 1, wherein at least one of the PCB patches includes a plurality of antennas.

9. A method of forming a patch array, the method comprising:

providing a routing substrate having a plurality of layers for routing signals;

providing a plurality of printed circuit board (PCB) patches, each PCB patch having at least one through-via and comprising communication circuitry configured to communicate in the 5G spectrum operating at relative bandwidths, within a given spectrum of the 5G spectrum, of between about 8 percent and about 70 percent; and surface mounting each of the plurality of PCB patches to the routing substrate to form the patch array, wherein the routing substrate and the PCB patches are printed circuit boards fabricated at the board level using standard printed circuit board fabrication processes and design rules.

10. The method of claim 9, wherein the relative bandwidths are between about 24 GHz and 49 GHz.

11. The method of claim 9, wherein each PCB patch is surface mounted to the routing substrate using a ball grid array.

12. The method of claim 9, wherein the given spectrum has a highest frequency and a lowest frequency, the relative bandwidth being the difference between the highest and lowest frequencies divided by the midpoint frequency between the highest and lowest frequencies.

13. The method of claim 9, wherein the routing substrate has standard vias.

14. The method of claim 9, wherein the routing substrate and the plurality of patches are free of micro-vias.

15. The method of claim 9, wherein at least one of the PCB patches is a stacked patch.

16. The method of claim 9, wherein at least one of the PCB patches includes a plurality of antennas.

17. The method of claim 9, wherein providing the plurality of PCB patches comprises forming the plurality of PCB patches on a single printed circuit board.

* * * * *